US007621498B2

(12) United States Patent
Tang

(10) Patent No.: US 7,621,498 B2
(45) Date of Patent: Nov. 24, 2009

(54) HANGER FOR A CEILING FAN

(75) Inventor: Yung-Yu Tang, Tanzih Township, Taichung County (TW)

(73) Assignee: Air Cool Industrial Co., Ltd., Taichung County (TW)

( * ) Notice: Subject to any disclaimer, the term of this patent is extended or adjusted under 35 U.S.C. 154(b) by 142 days.

(21) Appl. No.: 12/049,912

(22) Filed: Mar. 17, 2008

(65) Prior Publication Data

US 2009/0230274 A1 Sep. 17, 2009

(51) Int. Cl.
*B42F 13/00* (2006.01)

(52) U.S. Cl. ..... 248/343; 248/562; 248/566; 248/317; 416/224 R; 416/246; 403/90; 403/93

(58) Field of Classification Search ..... 248/343, 248/317, 323, 324, 342, 318, 544, 562, 566, 248/609, 634, 610, 288.31, 693; 416/224 R, 416/246; 403/90, 93
See application file for complete search history.

(56) References Cited

U.S. PATENT DOCUMENTS 5,090,654 A * 2/1992 Ridings et al. ..... 248/343
6,203,279 B1 * 3/2001 Moody et al. ..... 416/244 R
6,280,145 B1 * 8/2001 Liu ..... 416/244 R
6,981,678 B2 * 1/2006 Fu-Liang ..... 248/343
7,080,813 B1 * 7/2006 Frampton et al. ..... 248/343
7,510,160 B1 * 3/2009 Wang ..... 248/343

* cited by examiner

*Primary Examiner*—J. Allen Shriver
*Assistant Examiner*—Todd M. Epps
(74) *Attorney, Agent, or Firm*—Ming Chow; Sinorica, LLC

(57) ABSTRACT

A hanger for a ceiling fan is formed with a conical receiving opening contracted downward gradually and having a hard hanging spherical member received therein. The hanging spherical member has its outer circumference annularly provided with a stop ring whose diameter is larger than the inner diameter of the receiving opening. A shock-absorbing cover is covered around the outer circumference under the stop ring of the hanging spherical member, having its inner circumferential camber matching with the outer circumferential camber of the hanging spherical member to enable the shock-absorbing cover to stably cover the hanging spherical member, and its outer circumference completely touching the inner edge of the receiving opening, avoiding the hanging spherical member dropping downward, preventing noises from produced and effectively elevating stability of the hanger.

8 Claims, 7 Drawing Sheets

HANGER FOR A CEILING FAN

BACKGROUND OF THE INVENTION

1. Field of the Invention

This invention relates to a hanger for a ceiling fan, particularly to one able to effectively elevate its stability and prolong its service life.

2. Description of the Prior Art

A first conventional ceiling fan 10, as shown in FIG. 1, includes a fan motor 12 for driving a fan blade unit 11 to rotate and a hanging rod 13 inserted through the fan motor 12 and extended forward axially with its upper end axially inserted through a hanging spherical member 14 so that the hanging rod 13 may be hung on the hanging spherical member 14 by means of a fixing pin 131. A hanger 15 for holding and carrying the hanging spherical member 14 is provided with two opposite locking lugs 16 to be locked on a ceiling. The two opposite locking lugs 16 are respectively extended downward and connected to form an annular bearer 17 formed with a hollow receiving opening 18 to receive the hanging spherical member 14 therein for hanging the ceiling fan 10.

Although the first conventional ceiling fan 10 can be driven by the fan motor 12 to function, yet the conventional ceiling fan 10 has the following defects.

1. The hanger 15 and the hanging spherical member 14 generally made of zinc, aluminum or plastic steel are respectively formed with a hard surface and there is not any shock-absorbing member provided between them for absorbing vibration sound waves, disabling the hanging spherical member 14 and the hanger 15 to adhere together effectively. Therefore, when the fan motor 12 is rotated and produces vibration, its vibration force will be transmitted to both the hanging rod 13 and the hanging spherical member 14 and make them vibrate and swing to a comparatively great extent.

2. When rotated, the fan motor 12 is likely to cause electrical noises, and such noises will surely be transmitted to the ceiling via the hanging rod 13, the hanging spherical member 14 and the hanger 15, due to resonance effect, will produce noises unpleasant to the ear.

3. If the hanging spherical member 14 is made of plastic, vibration and noises can be reduced, but the plastic hanging spherical member 14 may cause fragmentation after used for a long period of time, or may result in breakage caused by overload, likely to make the ceiling fan drop down dangerously.

Next, a second conventional ceiling fan hanger, as shown in FIG. 2, has a central portion of the outer circumference of the hanging spherical member 14 bored with an annular recess 141 adhered therein with an elastic PU plastic shock-absorbing layer 142 having its outer circumferential edge exactly contacting with the inner circumference of the receiving opening 18 of the hanger 15. Thus, the hanging spherical member 14 can be avoided directly touching the inner circumference of the receiving opening 18 of the hanger 15 so as to lower the extent of vibration that the hanging rod 13 and the hanging spherical member 14 receive from rotation of the ceiling fan motor 12, with the shock-absorbing layer 142 functioning to absorb vibration sound waves. However, the shock-absorbing layer 142 is only covered on a central circumferential edge of the hanging spherical member 14; therefore, if the fan motor 12 is fixed on a slanting ceiling, while the hanging spherical member 14 connected with the fan motor 12 is positioned vertically because of gravity and combined with the slanting hanger 15, the shock-absorbing layer 142 will be unable to completely contact with the inner circumferential edge of the receiving opening 18 of the hanger 15.

Under the circumstances, parts of the hanging spherical member 14, which are provided with no shock-absorbing layer 142, will touch the hanger 15 and transmit the vibration sound waves to the ceiling to produce resonant sounds with high frequency noises.

SUMMARY OF THE INVENTION

This invention is devised to offer a hanger for a ceiling fan, which is formed with a conical opening contracted downward gradually and having a hard hanging spherical member received therein. The hanging spherical member has its outer circumference annularly provided at a preset location with a stop ring whose diameter is larger than the inner diameter of the receiving opening. A shock-absorbing cover is covered around the outer circumference under the stop ring of the hanging spherical member, having its inner circumferential camber matching with the outer circumferential camber of the hanging spherical member to enable the shock-absorbing cover to be stably covered around the hanging spherical member, and its outer circumference completely contacting with the inner circumference of the receiving opening. The hanging spherical member is formed with a diameter larger than the inner diameter of the receiving opening of the hanger so as to prevent the hanging spherical member from dropping down. By so designing, the hanging spherical member can be prevented from touching the hanger when the ceiling fan is assembled on different-angle ceilings, effectively avoiding producing resonant sounds with high frequency noises when the ceiling fan is rotated, preventing the shock-absorbing cover from causing fragmentation or breakage after it is used for a long period of time, and elevating the stability and the service life of the hanger.

BRIEF DESCRIPTION OF DRAWINGS

This invention will be better understood by referring to the accompanying drawings, wherein.

DETAILED DESCRIPTION OF THE PREFERRED EMBODIMENT

Figure 3:
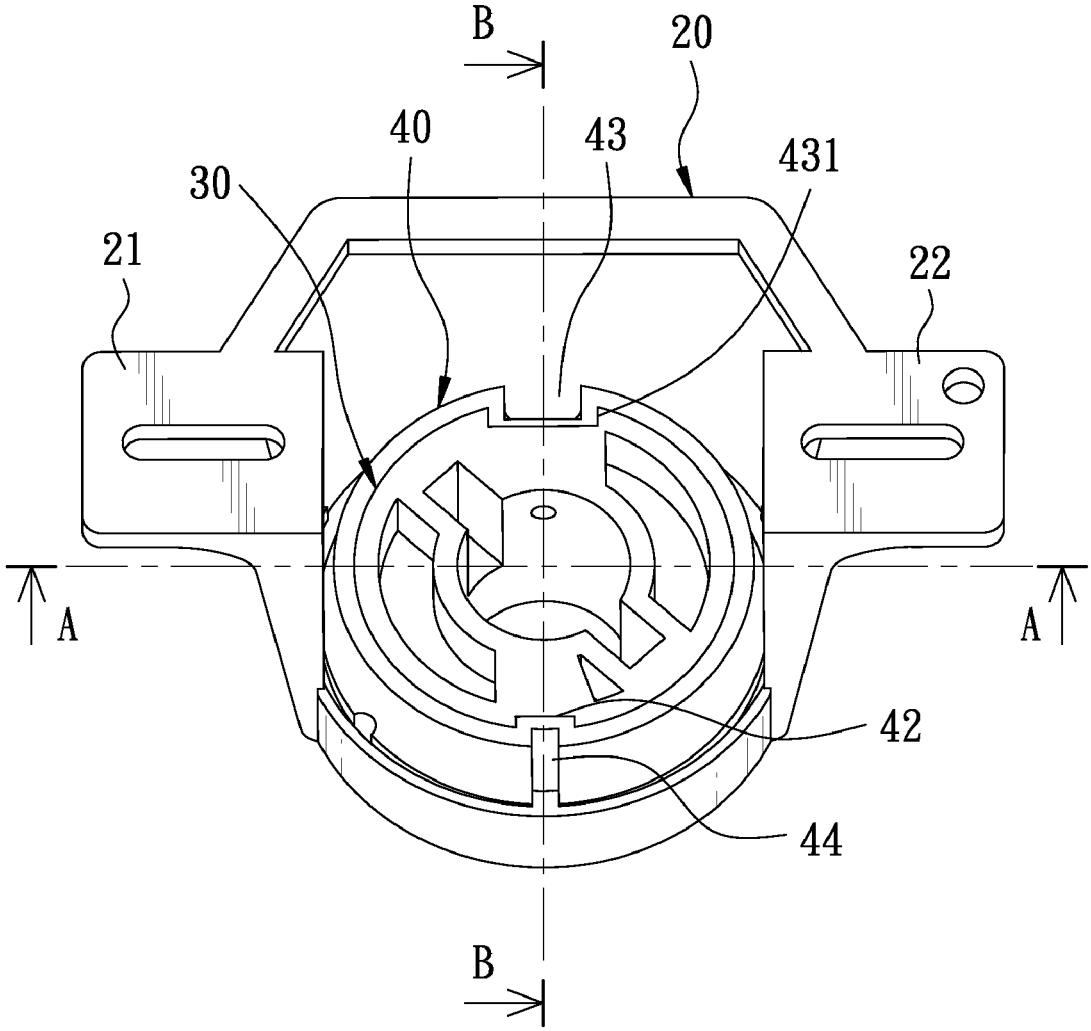
FIG. 3 is an upper view of a first preferred embodiment of a hanger for a ceiling fan in the present invention.

A first preferred embodiment of a hanger for a ceiling fan in the present invention, as shown in FIG. 3, includes a hanger 20, a hanging spherical member 30 and a shock-absorbing cover 40 as main components combined together.

Figure 1:
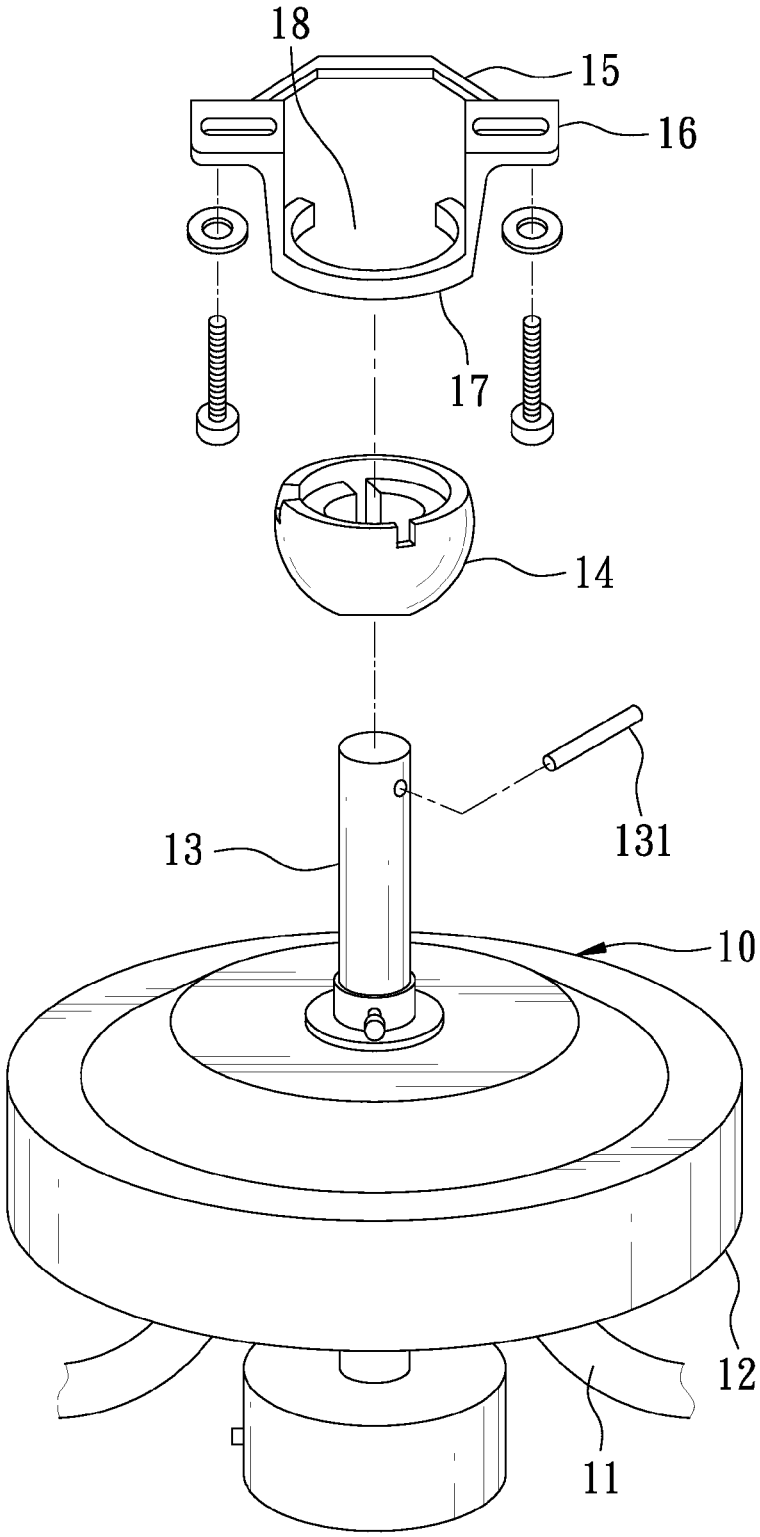
FIG. 1 PRIOR ART
FIG. 1 is an exploded perspective view of a first conventional ceiling fan hanger.
Figure 2:
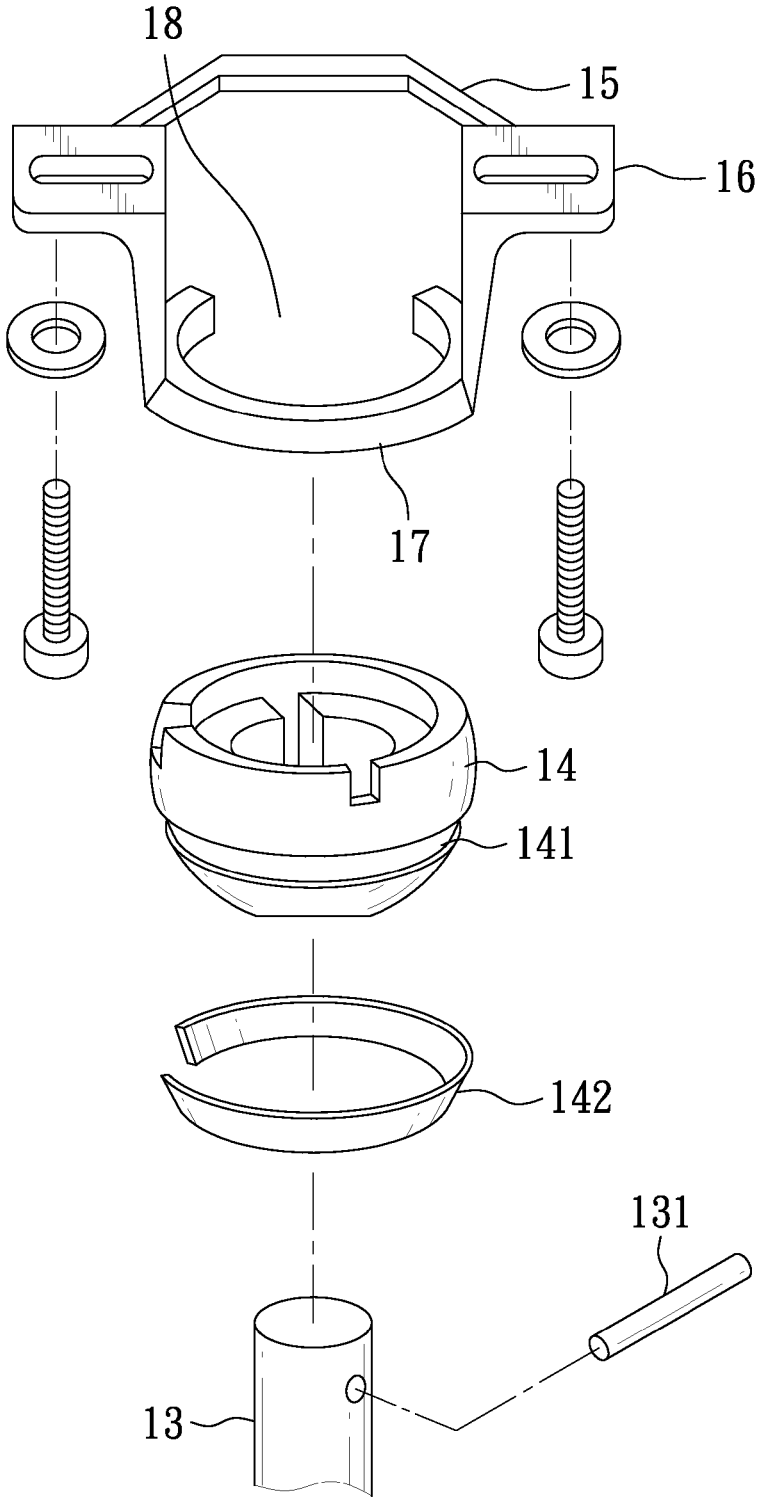
FIG. 2 PRIOR ART
FIG. 2 is an exploded perspective view of a second conventional ceiling fan hanger.
Figure 4:
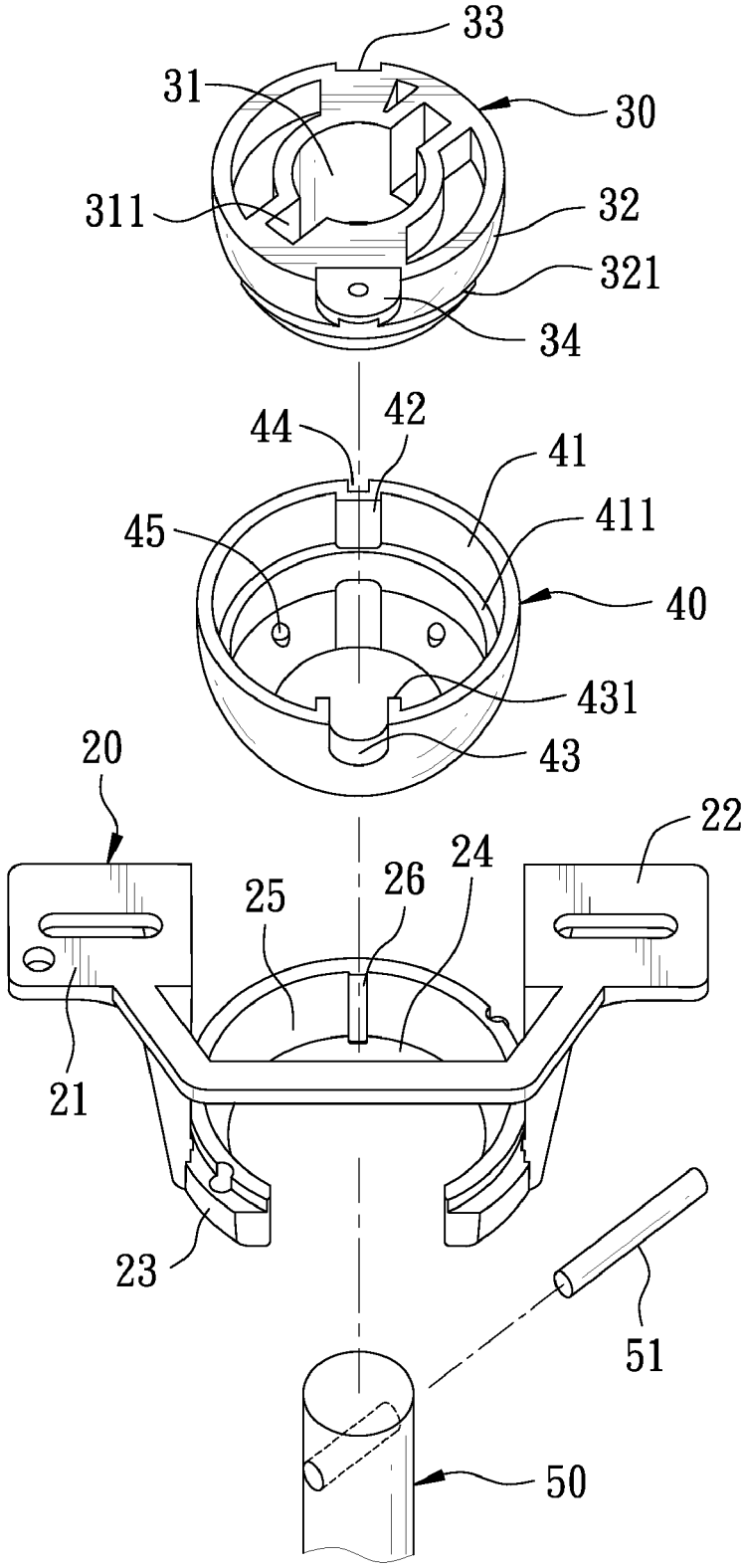
FIG. 4 is an exploded perspective view of the first preferred embodiment of the hanger for a ceiling fan in the present invention.

The hanger 20, referring to FIG. 4, is to be firmly assembled at a proper location of a ceiling and has the left and right side of its upper edge respectively provided with a locking lug 21, 22 extended out transversely to be locked on the ceiling. The two locking lugs 21, 22 have their lower ends respectively extended and formed with an annular bearer 23 bored in the center with a receiving opening 24 defined by a conical receiving surface 25 of the annular bearer 23, and the conical opening surface 25 is contracted downward gradually and larger than the inner edge of the conventional receiving opening 18 shown in FIG. 1. The receiving surface 25 at the rear end of the annular bearer 23 is axially fixed thereon at the central point with a rectangular positioning post 26.

Figure 5:
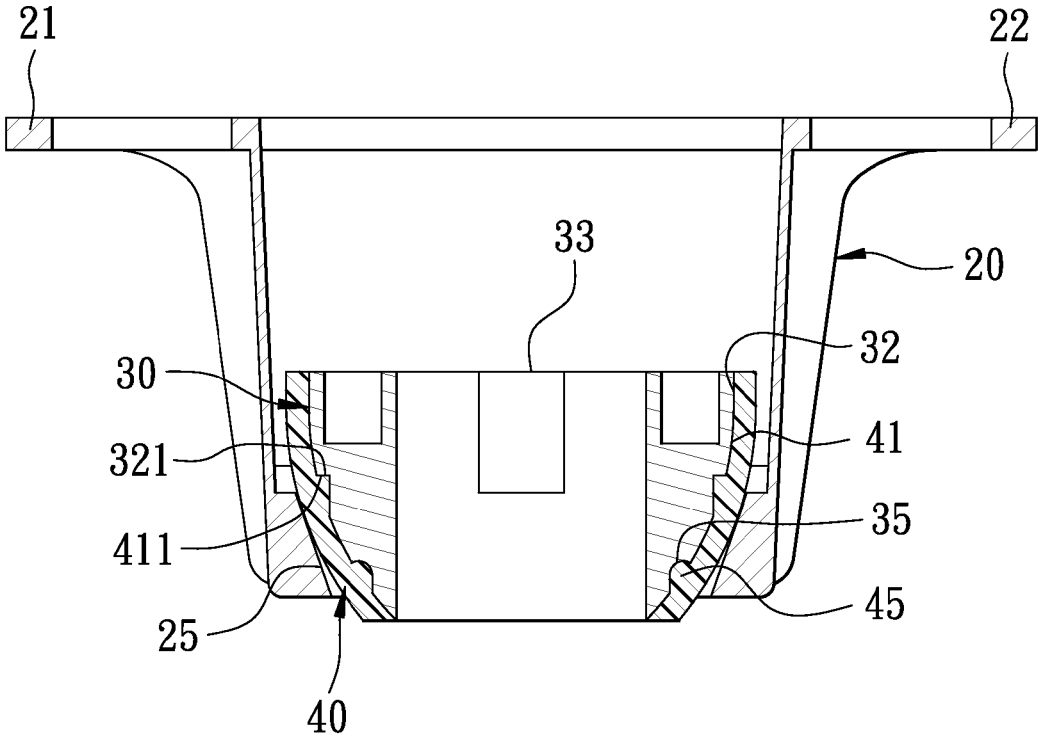
FIG. 5 is a cross-sectional view of the line A-A in FIG. 3.

The hanging spherical member 30 to be received in the receiving opening 24 is a conical hollow body contracted downward gradually and having its center bored with an axial insert hole 31 for fitting the upper end of a hanging rod 50 therein. The insert hole 31 has its opposite sides respectively cut from above with a notch 311 for engaging and positioning the opposite ends of a fixing pin 51 that is transversely inserted through the upper end of the hanging rod 50 after the hanging rod 50 is inserted in the upper side of the insert hole 31, and a fan motor (not shown) is fixed and hung at the lower end of the hanging rod 50. The hanging spherical member 30 made of zinc or aluminum has its upper outer circumferential edge annularly disposed with a stop ring 32 for preventing the hanging spherical member 30 from dropping down, having a diameter larger than the inner diameter of the inner circumferential edge of the receiving opening 24 of the hanger 20, and the stop ring 32 has its lower end formed with a stop surface 321. Further, the hanging spherical member 30 has its rear outer circumferential edge axially cut from above with a rectangular fixing groove 33, and the stop ring 32 has an outer circumferential edge at the opposite side of the fixing groove 33 bored with a U-shaped insert groove 34 with an upward opening. Referring to FIG. 5, the stop ring 32 of the hanging spherical member 30 has its gradually-contracted lower outer circumferential edge annularly bored with four circular recesses 35 spaced apart equidistantly at proper locations.

The shock-absorbing cover 40, as shown in FIGS. 4 and 5, is a hollow bowl-shaped body made of elastic plastic to be completely covered around the outer circumference of the hanging spherical member 30. The shock-absorbing cover 40 has its inner circumference matching with the shape of the outer circumference of the hanging spherical member 30 and its inner circumferential camber tallying with the camber of the circumference from the lower outer edge to the upper outer edge of the hanging spherical member 30. Further, the shock-absorbing cover 40 has its upper inner side bored with an annular stop recess 41 matching with the stop ring 32 of the hanging spherical member 30, and the annular stop recess 41 has its lower end formed with a projecting stop surface 411 corresponding with the stop surface 321 of the hanging spherical member 30 for pushing against the stop surface 321. Furthermore, the shock-absorbing cover 40 has the central portion of its outer circumference completely resisting against and contacting with the upper edge of the conical receiving surface 25 inside the hanger 20.

Figure 6:
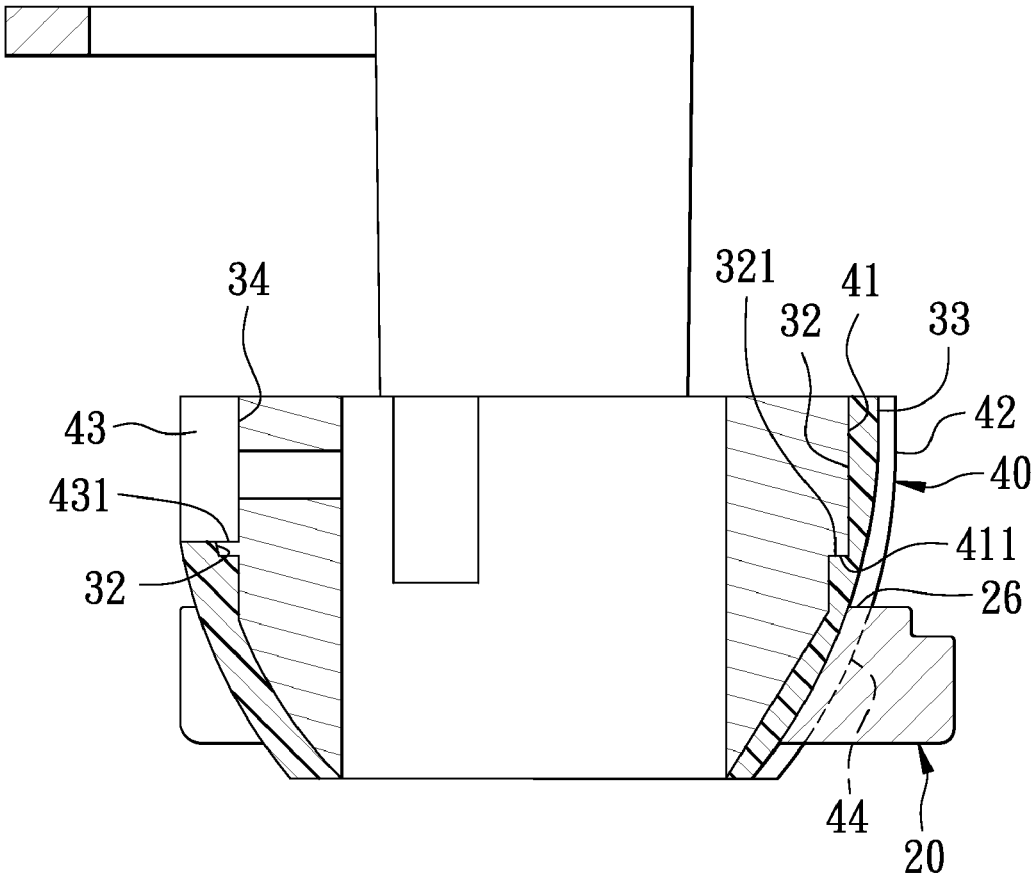
FIG. 6 is a cross-sectional view of the line B-B in FIG. 3.

In addition, referring to FIG. 6, the shock-absorbing cover 40 has an inner edge, corresponding to the location of the fixing groove 33 of the hanging spherical member 30, provided with a fixing post 42 protruding toward the center to be inserted in the fixing groove 33. The shock-absorbing cover 40 further has another side, opposite to the fixing post 42, cut from above with a U-shaped notch 43 matching with the U-shaped insert groove 34 of the hanging spherical member 30, and the U-shaped notch 43 has the inside of its opposite ends respectively fixed with an insert block 431 transversely extending toward the insert groove 34 to be engaged firmly with the insert groove 34. Moreover, the shock-absorbing cover 40 has an outer side abutting the fixing post 42 bored from the upper edge with a positioning groove 44 matching with the positioning post 26 of the hanger 20 and its lower inner circumference disposed with four circular projections 45 spaced apart equidistantly at locations respectively corresponding with the four circular recesses 35 at the lower side of the hanging spherical member 30 for mutual engagement.

In assembling, as shown in FIGS. 5 and 6, firstly, the shock-absorbing cover 40 is fitted around the hanging spherical member 30 from under, letting the fixing post 42 aligned to and engaged with the fixing groove 33, and the insert block 431 aligned to and inserted in the insert groove 34. Thus, the stop ring 32 of the hanging spherical member 30 can be engaged and fixed in the stop groove 41 of the shock-absorbing cover 40, letting the four recesses 35 at the lower side of the hanging spherical member 30 respectively engaged with the four projections 45 of the shock-absorbing cover 40 to enable the shock-absorbing cover 40 to be stably covered around the hanging spherical member 30. Next, the hanging rod 50 has its lower end secured and hung with the fan motor and its upper end inserted in the insert hole 31 of the hanging spherical member 30, and then the fixing pin 51 is transversely inserted and fixed in the upper end of the hanging rod 50 and has its opposite ends respectively stuck in the notches 311 at the opposite sides of the insert hole 31. Subsequently, the shock-absorbing cover 40 has its positioning groove 44 engaged with the positioning post 26 of the hanger 20, letting the hanger 20 and the hanging spherical member 30 completely separated by the shock-absorbing cover 40 to avoid the hanging spherical member 30 directly contacting with the hanger 20. Lastly, the two lock lugs 21, 22 of the hanger 20 are firmly locked on the ceiling to finish assembly of the ceiling fan.

Figure 7:
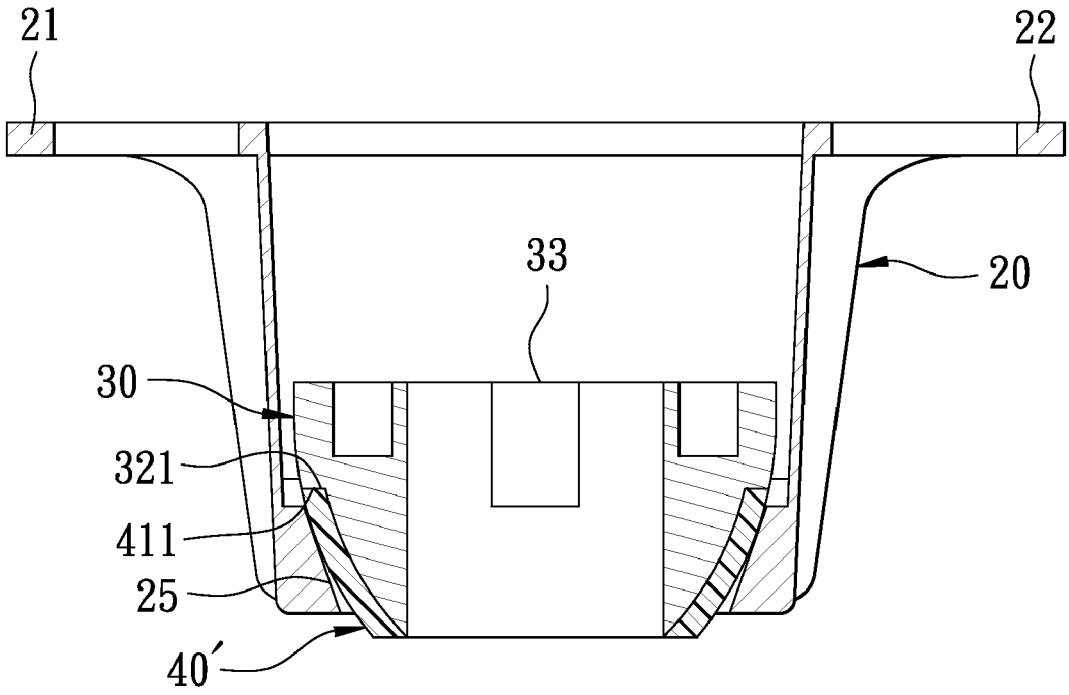
FIG. 7 is a cross - sectional view of a second preferred embodiment of a hanger for ceiling fan in the present invention.

A second preferred embodiment of a hanger of a ceiling fan in the present invention, as shown in FIG. 7, has almost the same structure and function as those described in the first preferred embodiment, except that the shock-absorbing cover 40' is covered around the hanging spherical member 30 from the lower edge to a preset height of the upper end of the outer circumference of the hanging spherical member 30. The shock-absorbing cover 40' has its upper circumferential edge formed with a projecting stop surface 411 corresponding with the stop surface 321 of the hanging spherical member 30 for resisting against each other. The shock-absorbing cover 40' has its upper and lower edge respectively exceeding the upper and the lower edge of the receiving surface 25 of the hanger 20 to enable the outer circumference of the shock-absorbing cover 40' to completely hold and touch the receiving surface 25. Thus, even if the fan motor is positioned slanting slightly, the outer circumference of the shock-absorbing cover 40' still can completely cover up the receiving surface 25 of the hanger 20, thus achieving effect of shock absorption.

As can be understood from the above description, this invention has the following advantages.

1. The receiving surface of the hanger can completely contact with the outer circumference of the elastic and soft shock-absorbing cover, and the shock-absorbing cover is completely covered around the outer circumferential edge of the hanging spherical member, thus enhancing effect of sticking the hanging spherical member to the hanger. By so designing, after the vibration produced by the ceiling fan motor is transmitted to both the hanger and the hanging spherical member, the vibration will be absorbed by the shock-absorbing cover and since the hanging spherical member is stably stuck to the shock-absorbing cover, the hanging rod and the hanging spherical member will not be actuated to swing, thus effectively elevating the stability and prolonging the service life of the hanger.

2. The stop groove of the shock-absorbing cover can exactly be engaged with the stop ring of the hanging spherical member to enable the shock-absorbing cover to be completely and stably covered around the hanging spherical member, and hence the hanging spherical member can be prevented from directly touching the hanger when the ceiling fan is assembled on different-angle ceilings, thus effectively avoiding resonant sounds with high frequency noises produced by operation of the ceiling fan. In addition, the diameter of the hanging spherical member is larger than the internal diameter of the receiving opening of the hanger; therefore, when the shock-absorbing member is used for long and causes fragmentation or breakage, the hanging spherical member still can be stuck in the receiving opening not to drop down.

While the preferred embodiments of the invention have been described above, it will be recognized and understood that various modifications may be made therein and the appended claims are intended to cover all such modifications that may fall within the spirit and scope of the invention.

I claim:

1. A hanger for a ceiling fan comprising:

a hanger firmly assembled on a ceiling, said hanger having opposite sides of its upper edge respectively extended downward transversely to form a locking lug to be locked on said ceiling, said locking lugs having their lower ends respectively extended downward and formed with an annular bearer, said annular bearer formed with a receiving opening in the interior, said receiving opening having its inner circumference disposed with a conical receiving surface contracted downward gradually;

a hanging spherical member made of metal and positioned in said receiving opening of said hanger, said hanging spherical member bored with an insert hole in its center for firmly receiving a hanging rod therein, said hanging spherical member having its outer circumferential edge annularly provided with a protruding stop ring at a preset location for preventing said hanging spherical member from dropping down, said stop ring formed with a diameter larger than an internal diameter of inner edge of said receiving opening of said hanger, said stop ring having its lower end formed with a stop surface; and a shock-absorbing cover at least covered around an outer circumference under said stop ring of said hanging spherical member and resisting against said stop surface, said shock-absorbing cover having its upper and lower edge respectively exceeding upper and lower edge of said receiving surface of said hanger, said shock-absorbing cover being a hollow body made of elastic plastic, said shock-absorbing cover having its inner circumferential camber matching with an outer circumferential camber of said hanging spherical member, said shock-absorbing cover having its outer circumference completely resisting and touching said receiving surface of said hanger.

2. The hanger for a ceiling fan as claimed in claim 1, wherein said shock-absorbing cover is completely covered around outer circumference of said hanging spherical member.

3. The hanger for a ceiling fan as claimed in claim 2, wherein said shock-absorbing cover is annularly bored with a stop groove at a location corresponding with said stop ring of said hanging spherical member, said stop groove formed with a projecting stop surface tallying with said stop surface of said hanging spherical member for resisting against each other.

4. The hanger for a ceiling fan as claimed in claim 2, wherein said hanging spherical member has an upper outer edge of one side of its outer circumference cut downward with a fixing groove, and said shock-absorbing cover has its inner circumference disposed with a fixing post at a location matching with said fixing groove to be inserted and fixed in said fixing groove.

5. The hanger for a ceiling fan as claimed in claim 2, wherein said hanging spherical member has an upper edge of its outer circumference bored with a U-shaped insert groove with an upward opening at one side opposite to said fixing groove, and said shock-absorbing cover is disposed with an insert block matching with said insert groove of said hanging spherical member for mutual engagement.

6. The hanger for a ceiling fan as claimed in claim 2, wherein said shock-absorbing cover has an upper outer edge of one side bored downward with a positioning groove, and said receiving surface of said hanger is fixed with a positioning post at a location corresponding with said positioning groove to be inserted and fixed in said positioning groove.

7. The hanger for a ceiling fan as claimed in claim 2, wherein said hanging spherical member has an outer circumferential edge under said stop ring bored with a plurality of recesses at preset locations, and said shock-absorbing cover is provided with a plurality of projections at locations respectively tallying with said recesses of said hanging spherical member.

8. The hanger of a ceiling fan as claimed in claim 1, wherein said shock-absorbing cover is covered around said hanging spherical member from a lower edge of outer circumference to a preset height of an upper end of said hanging spherical member, said shock-absorbing cover having its upper inner circumferential edge disposed with a projecting stop surface corresponding with said stop surface of said hanging spherical member for resisting against each other, said shock-absorbing cover having its upper and lower edge respectively exceeding an upper and a lower edge of said receiving surface of said hanger.

* * * * *